US010144441B2

(12) United States Patent
Fischer et al.

(10) Patent No.: US 10,144,441 B2
(45) Date of Patent: Dec. 4, 2018

(54) OPERATION OF A RAIL VEHICLE COMPRISING AN IMAGE GENERATION SYSTEM

(71) Applicant: Bombardier Transportation GmbH, Berlin (DE)

(72) Inventors: Michael Fischer, Vienna (AT); Gerald Newesely, Vienna (AT)

(73) Assignee: Bombardier Transportation GmbH, Berlin (DE)

( * ) Notice: Subject to any disclaimer, the term of this patent is extended or adjusted under 35 U.S.C. 154(b) by 56 days.

(21) Appl. No.: 15/525,751

(22) PCT Filed: Nov. 10, 2015

(86) PCT No.: PCT/EP2015/076211

§ 371 (c)(1),
(2) Date: Oct. 4, 2017

(87) PCT Pub. No.: WO2016/075138

PCT Pub. Date: May 19, 2016

(65) Prior Publication Data

US 2018/0257684 A1 Sep. 13, 2018

(30) Foreign Application Priority Data

Nov. 10, 2014 (DE) ..... 10 2014 222 900

(51) Int. Cl.
*B61L 23/04* (2006.01)
*B61L 27/00* (2006.01)
(Continued)

(52) U.S. Cl.
CPC ..... *B61L 23/041* (2013.01); *B61L 15/0072* (2013.01); *B61L 27/0005* (2013.01); *B61L 27/0077* (2013.01); *B61L 27/04* (2013.01)

(58) Field of Classification Search
CPC ..... B61L 23/041; B61L 27/0077; B61L 15/0072; B61L 27/0005; B61L 27/04
See application file for complete search history.

(56) References Cited

U.S. PATENT DOCUMENTS 4,855,822 A 8/1989 Narendra et al.
5,530,420 A 6/1996 Tsuchiya et al.
(Continued)

FOREIGN PATENT DOCUMENTS

CN 102085873 A 6/2011
CN 102113017 A 6/2011
(Continued)

*Primary Examiner* — Russell Frejd
(74) *Attorney, Agent, or Firm* — The Webb Law Firm

(57) ABSTRACT

The invention relates to a rail vehicle including an image generation system for capturing a space outside the rail vehicle. The image generation system includes four image generation devices, each of which, during operation of the image generation system, generates two-dimensional images of the space. A first and a second of the four image generation devices are disposed at a first distance from one another on the rail vehicle and form a first stereo pair, which captures a first shared portion of the space from different viewing angles. A third and a fourth of the four image generation devices are disposed at a second distance from one another on the rail vehicle and form a second stereo pair, which detects a second shared portion of the space from different viewing angles. The first shared portion of the space and the second shared portion of the space have a shared spatial region.

15 Claims, 7 Drawing Sheets

(51) Int. Cl.
*B61L 15/00* (2006.01)
*B61L 27/04* (2006.01)

(56) References Cited

U.S. PATENT DOCUMENTS

| | | | | |
|---|---|---|---|---|
| 5,535,144 | A | 7/1996 | Kise | |
| 6,298,286 | B1 | 10/2001 | Ying | |
| 6,778,097 | B1 | 8/2004 | Kajita et al. | |
| 8,255,098 | B2 | 8/2012 | Jones et al. | |
| 8,437,536 | B2 | 5/2013 | Saito | |
| 2009/0012657 | A1 | 1/2009 | Knotts et al. | |
| 2010/0033617 | A1 | 2/2010 | Forutanpour | |
| 2010/0100275 | A1* | 4/2010 | Mian | G01M 17/013 701/31.4 |
| 2010/0176251 | A1 | 7/2010 | Kister | |
| 2011/0169943 | A1* | 7/2011 | Bachman, II | G06K 9/209 348/117 |
| 2012/0294485 | A1* | 11/2012 | Kasaoki | G08G 1/166 382/103 |
| 2012/0307108 | A1 | 12/2012 | Forutanpour | |
| 2013/0076241 | A1 | 3/2013 | Schofield et al. | |
| 2013/0077825 | A1* | 3/2013 | Katahira | G06K 9/00805 382/103 |
| 2013/0194426 | A1 | 8/2013 | Schofield et al. | |
| 2014/0218482 | A1 | 8/2014 | Prince | |
| 2015/0235094 | A1* | 8/2015 | Kraeling | G06K 9/00791 348/148 |

FOREIGN PATENT DOCUMENTS

| | | | |
|---|---|---|---|
| DE | 4447788 | B4 | 9/1994 |
| DE | 1446452 | A1 | 6/1995 |
| DE | 10244127 | A1 | 4/2004 |
| DE | 10341426 | A1 | 4/2005 |
| DE | 10353212 | A1 | 6/2005 |
| DE | 102005057273 | A1 | 5/2007 |
| DE | 102006056937 | A1 | 6/2008 |
| DE | 102009005860 | A1 | 10/2009 |
| DE | 102008046963 | A1 | 6/2010 |
| DE | 102009040221 | A1 | 3/2011 |
| DE | 102010004653 | A1 | 7/2011 |
| DE | 102011004576 | A1 | 8/2012 |
| EP | 2050671 | A1 | 4/2009 |
| WO | 2004028881 | A1 | 4/2004 |
| WO | 2009013167 | A1 | 1/2009 |

* cited by examiner

OPERATION OF A RAIL VEHICLE COMPRISING AN IMAGE GENERATION SYSTEM

CROSS-REFERENCE TO RELATED APPLICATIONS

This application is the United States national phase of International Application No. PCT/EP2015/076211 filed Nov. 10, 2015, and claims priority to German Patent Application No. 10 2014 222 900.6 filed Nov. 10, 2014, the disclosures of which are hereby incorporated in their entirety by reference.

FIELD OF THE INVENTION

The invention relates to a rail vehicle comprising an image generation system for capturing a space outside the rail vehicle. The invention furthermore relates to a system for operating a rail vehicle. Moreover, the invention relates to a method for operating a rail vehicle.

DESCRIPTION OF RELATED ART

It is known to operate rail vehicles on routes that are free of other traffic without drivers. With respect to passenger traffic, rail vehicles are designed to have the capacity to carry more passengers than most types of motorized road vehicles. Examples of driverless rail vehicles are so-called people movers operating between the various parts of airports. Rail vehicles have the advantage that they are guided on their track by externally acting forces and not able to leave the route, wherein, however, the option exists in many systems to select one of multiple travel tracks when encountering switches. As a result of the track guidance, rail vehicles do not necessarily have to be steered, as is the case with motorized road vehicles. Rail vehicles are therefore well-suited for autonomous, driverless operation. During driverless operation in spaces which are also frequented by persons and/or not track-guided vehicles, it must be ensured when operating rail vehicles in a driverless manner that other road users are not jeopardized, in particular due to possible collisions.

When rail vehicles are controlled by a driver, driver assistance systems can be used, which support the driver in the decision he or she takes to control the vehicle. For example, collision warning systems are known, which warn the driver about impending, possible collisions. Radar sensors, ultrasonic sensors, laser triangulation systems and/or image generation devices, such as digital cameras, for example, can be used in such systems to generate two-dimensional images of the space outside the rail vehicle. By evaluating the image, the depth of a possible collision object, which is to say the distance from the image generation device, can be established. Apart from the use of stereo systems, it is also possible to compare image objects in individual images having known depth positions, which can be determined, for example, on travel tracks along which objects extend at constant intervals or of known lengths.

Aside from the advantage of not necessarily needing steering, however, the operation of rail vehicles is also associated with the disadvantage that no evasive maneuvers are possible in the event of an impending collision, and the obstacle also cannot be circumnavigated even when deceleration takes place in a timely manner. This is associated with the requirement that the rail vehicle, in keeping with the envelope thereof, which is determined by the maximum extension of the vehicle cross-section, always requires sufficient space, which extends immovably along the route. The envelope is also determined by static effects, in particular by kinematic effects, and by dynamic effects, in particular elastic deformations (such as spring deflections) of the vehicle. In contrast to trucks and other vehicles operated on roads in a freely steerable manner, rail vehicles frequently have larger vehicle lengths measured in the driving direction, which impacts the clearance required for negotiating curves and makes it more difficult to capture the vehicle outside space relevant for operating the vehicle. Compared to road vehicles equipped with rubber tires, rail vehicles running on rails made of metal also transmit lower acceleration and brake forces to the travel track.

SUMMARY OF THE INVENTION

Autonomous, driverless operation of a rail vehicle thus presents particular requirements in traffic spaces not free of other traffic.

It is an object of the present invention to provide a rail vehicle comprising an image generation system, and a method for operating such a rail vehicle, which allow reliable autonomous driving operation. It is a further object to be able to preferably continue the driving operation even when an obstacle is blocking, or appears to be blocking, the route. For this purpose, a system for operating a rail vehicle and a method for operating the system are to be provided.

Three measures are provided hereafter, by way of which the reliability of a rail vehicle during the autonomous, driverless operation, but also during operation with a driver in the rail vehicle is increased. All three of these measures are preferably carried out or implemented in combination with one another. However, it is also possible to implement the three measures individually, or an arbitrary combination of two of the measures. In particular, an arbitrary of the measures can be carried out, and the two other measures, either individually or in combination with one another, can be referred to as a refinement of the measure. Each of the measures can include a device or a system, and additionally an operating method for operating the device or the system.

According to a first measure, a rail vehicle comprises an image generation system for capturing a space outside the rail vehicle, wherein a plurality of image generation devices is provided, which form a first stereo pair and a second stereo pair. The image generation devices of each of the stereo pairs capture a shared portion of the space from different viewing angles, whereby a calculation of depth information is made possible. However, such a calculation is not absolutely necessary. Rather, the images generated by the respective stereo pair can be represented separately, and in particular represented in such a way that a person discerns the image of one of the image generation devices with the right eye and the image of the other image generation device of the stereo pair with the left eye. In this way, the same or a similar spatial impression is created as if the person were to observe the space directly with his or her own eyes.

The distance of the image generation devices of the first stereo pair is in particular greater than the distance of the image generation devices of the second stereo pair. Thus, at least three image generation devices are required. However, it is a realization of the invention that the image generation system is more reliably available if the image generation system comprises at least four image generation devices, wherein two image generation devices at a time form a stereo pair. If in the case of only three present image generation devices the device that is involved in both stereo pairs should fail or not be usable free of defects (which is to say free of faults), stereoscopic image acquisition would no longer be possible. In contrast, if at least four image generation devices are present, the failure of one image generation device does not cause the function of both stereo pairs to be faulty. At least one stereo pair remains functional. Furthermore, if also at least the images of three of the four image generation devices can be used free of faults, two stereo image pairs can be formed. The three image generation devices thus form two stereo pairs of devices and supply two stereo image pairs. At least one image of one of the three image generation devices will thus be used for both stereo image pairs. The information "at least four image generation devices" explicitly includes the case that the image generation system comprises more than four image generation devices. This also applies to all embodiments of the invention described hereafter.

Hereafter, a failed image generation device shall be understood to mean that this image generation device does not generate an image, that this image generation device does not generate an image that can be used for evaluation and/or that no transmission of one image, or of images, of this image generation device to an evaluation device takes place. A faulty image generation device shall be understood to mean that this image generation device generates at least one flawed image and/or that a transmission of one image, or of images, of this image generation device to the evaluation device is flawed. The cause for a flawed image may, for example, also be an obstacle between an object to be observed outside the vehicle and the image generation device. The flawed image, for example, does not allow the object to be recognized, or it depicts the object only in a blurred manner. For example, a windshield wiper of the vehicle moves along a windshield and causes one or more flawed images of an image sequence of the image generation device. It is thus preferred that it is not necessarily decided immediately after a faulty image has been recognized to no longer use the images of the image generation device. For example, one or more flawed images of an image sequence can be tolerated if thereafter at least one fault-free image is generated again in the same image sequence and/or an object tracked by evaluation of the images of the image sequence is again recognized from at least one image of the image sequence. A decision can be made situationally, for example, as to whether the images generated by the image generation device can be used further and thus the formation of other stereo pairs can be dispensed with.

In particular, the following is proposed: A rail vehicle comprising an image generation system for capturing a space outside the rail vehicle, wherein the image generation system comprises four image generation devices;

each of the four image generation devices during operation of the image generation system generates, or is able to generate, two-dimensional images of the space;

a first and a second of the four image generation devices are disposed at a first distance from one another on the rail vehicle and form a first stereo pair, which captures a first shared portion of the space from different viewing angles;

a third and a fourth of the four image generation devices are disposed at a second distance from one another on the rail vehicle and form a second stereo pair, which captures a second shared portion of the space from different viewing angles;

the first distance is greater than the second distance;

the first shared portion of the space and the second shared portion of the space have a shared spatial region;

an evaluation device of the image generation system, which is connected to the four image generation devices, during operation of the image generation system receives image data from the four image generation devices;

the image generation system recognizing when an evaluation of image data of a failed and/or faulty image generation device of the four image generation devices during an operating phase of the image generation system is not possible or flawed; it being possible for the failed and/or faulty image generation device to be any one of the four image generation devices;

the evaluation device, during the operating phase, using the image data, which the evaluation device receives from three other of the four image generation devices that are not the failed and/or faulty image data image generation device, as image data that contain a first stereo image pair and a second stereo image pair, the first stereo image pair corresponding to the image data of two of the three other image generation devices which are disposed at a third distance from one another on the rail vehicle, and the second stereo image pair corresponding to the image data of two of the three other image generation devices which are disposed at a fourth distance from one another on the rail vehicle, and the third distance and the fourth distance being different in size.

Furthermore, a method for operating a rail vehicle is proposed, wherein an image generation system of the rail vehicle comprising at least four image generation devices captures a space outside the rail vehicle;

each of the at least four image generation devices generates, or is able to generate, two-dimensional images of the space;

a first and a second of the at least four image generation devices are disposed at a first distance from one another on the rail vehicle and form a first stereo pair, which captures a first shared portion of the space from different viewing angles;

a third and a fourth of the at least four image generation devices are disposed at a second distance from one another on the rail vehicle and form a second stereo pair, which captures a second shared portion of the space from different viewing angles;

the first distance is greater than the second distance;

the first shared portion of the space and the second shared portion of the space have a shared spatial region;

an evaluation device of the image generation system, which is connected to the four image generation devices, during operation of the image generation system receives image data from the four image generation devices;

the image generation system recognizing when an evaluation of image data of a failed and/or faulty image generation device of the four image generation devices during an operating phase of the image generation system is not possible or flawed; it being possible for the failed and/or faulty image generation device to be any one of the four image generation devices;

the evaluation device, during the operating phase, using the image data, which the evaluation device receives from three other of the four image generation devices that are not the failed and/or faulty image data image generation device, as image data that contain a first stereo image pair and a second stereo image pair, the first stereo image pair corresponding to the image data of two of the three other image generation devices which are disposed at a third distance from one another on the rail vehicle, and the second stereo image pair corresponding to the image data of two of the three other image generation devices which are disposed at a fourth distance from one another on the rail vehicle, and the third distance and the fourth distance being different in size.

Depending on which stereo pairs were formed prior to the failure or the fault, the third distance or the fourth distance can, of course, agree with the first distance or the second distance.

The rail vehicle is, in particular, a light rail vehicle, such as a streetcar or a city rail vehicle.

It shall be clarified again that two options exist for generating the first stereo image pair and the second stereo image pair even when the operation of the image generation system is not faulty, if four image generation devices are available free of faults. According to the first option, all four image generation devices supply images that are used for the stereo image pairs. The image generation system can preferably be operated in this way. According to the second option, only images from three of the four image generation devices are used for the two stereo image pairs, which is to say at least one image of one of the three image generation devices is used for both stereo image pairs. In the above-used terminology, the first image generation device is then also the third or fourth image generation device, or the second image generation device is also the third or fourth image generation device.

For example, the evaluation device and/or another device of the image generation system can recognize that an evaluation of image data of the failed and/or faulty image generation device is not possible or is flawed. Such another device can be a device, for example, which processes images generated by the image generation devices solely for the purpose of recognizing the failure and/or the fault of an image generation device. In this case, the additional device outputs a signal to the evaluation device, for example a signal that unambiguously contains the information about the failed and/or faulty image generation device. To recognize the failure and/or the fault, at least one image can be checked in particular for the plausibility of the image content thereof. The image generation devices preferably generate images continuously over the course of time, and the corresponding sequence of images is also evaluated for the purpose of recognizing the failure and/or the fault. In the course of this, in one image of the image sequence, at least one object (for example, another vehicle or a person) can be recognized. During the evaluation, it is attempted to recognize this object also in subsequent images of the same image sequence. If the object has disappeared from at least one of the following images in a manner that is not plausible and/or has moved in a manner that is not plausible, a decision can be made that the image generation device is faulty, or at least the transmission or evaluation of images of this image generation device is faulty. If an image generation device fails, this can generally be easily established in that no image signal corresponding to an image is received from the evaluation device and/or the other unit, or that the received image signal has a property characteristic of failure, for example the distribution of the image values corresponds to white noise or too many image values have the same magnitude.

Since, in the event of a failure or a fault of one of the image generation devices, three image generation devices are still available and are also made available for the evaluation of two stereo image pairs, the reliability when capturing the spatial region is increased. In any case, with an arrangement of the three image generation devices which are not disposed at the corners of an equilateral triangle, it is always possible to define two stereo pairs of image generation devices in which the image generation devices of the individual stereo pairs have differing distances. This is in particular the case in the embodiment described hereafter comprising image generation devices disposed next to one another. Since two such stereo pairs having differing distances are to be formed in the event of a failure and/or fault of any one of the four image generation devices, and during the evaluation of the images also the corresponding stereo image pairs are formed, it holds true, worded in general terms, that no arbitrary group of three of the four image generation devices is arranged like the corner points of an equilateral triangle.

In particular, at least three of the four image generation devices can be disposed next to one another, so that all distances between the at least three of the four image generation devices are defined situated behind one another in a shared plane. In this way, it is ensured that stereo pairs formed of the image generation devices have differing distances between the image generation devices of the respective pair. Each of the stereo pairs can thus be designed to capture the shared spatial region, however at differing depths of focus.

In general it is preferred, not only in the case of image generation devices disposed next to one another, that the optical devices of the image generation devices during an operating phase of the image generation device each have a constant focal length. Image acquisition using constant focal lengths is particularly reliable and fast. The problem of having to decide which of the objects the image focuses on when several objects of interest are present in the captured region is avoided. Additionally, the time for focusing (which is to say for setting the focal length) can be saved, and more images per time interval can be generated in an image sequence. However, this does not preclude changing the focal length of the optical device of at least one of the image generation devices during the transition from a first operating phase into a second operating phase, for example since a failure and/or a fault of one of the image generation devices has been recognized. Such a change is even preferred to optimize the image generation system in the second operating phase. In particular, the image generation device which supplies images for both stereo image pairs can be set to a shorter focal length than before. This is based on the realization that an acquisition of objects (and in particular an acquisition of the contour of the respective respective object) at a distance that is considerably larger than the focal length is easily possible, while an acquisition of objects at a distance that is considerably smaller than the focal length is not possible, or results in considerable errors in the evaluation.

The first and second image generation devices and/or the third and fourth image generation devices are preferably disposed at a distance from one another in the horizontal direction, and the first distance and the second distance refer to the horizontal direction. This does not preclude (albeit not preferably) the two image generation devices of the same stereo pair (which is to say the first and second image generation devices or the third and fourth image generation devices) from being disposed at differing heights in or on the rail vehicle, wherein an arrangement at the same height is preferred, and/or from being disposed in the vehicle longitudinal direction at differing longitudinal positions, wherein an arrangement at the same longitudinal position is preferred. In particular, however, it is also possible for the first and third image generation devices to be disposed on top of one another at the same horizontal position and/or to be disposed directly next to one another in the horizontal direction at the smallest possible horizontal distance from one another, taking the designs thereof into consideration. In these two cases, for example, the stereoscopic image pairs recorded by the first stereo pair and the second stereo pair can be jointly evaluated in a particularly simple manner since the first shared portion of the space outside the rail vehicle captured by the first stereo pair and the second shared portion of the space captured by the second stereo pair each have a reference point defined by the first and third image generation devices, wherein the two reference points at least approximately have the same horizontal position or, when disposed next to one another in the horizontal direction, have the smallest possible horizontal distance from one another.

In particular, it can apply for each of the four image generation devices that the distances from any other of the four image generation devices are different in size. In the event of a failure or fault of any one of the four image generation devices, it is thus always possible to form favorable stereo pairs of the image generation devices, the stereo image pairs of which are well-suited for capturing the shared spatial region at differing acquisition depths. This means that, for example, the first stereo image pair captures the shared spatial region well at larger distances from the vehicle, and the second stereo image pair captures the shared spatial region well at smaller distances from the vehicle.

In particular, it is possible to calculate information about the depth of image objects that are captured in the images of a stereo image pair according to the principle of triangulation. Due to the distance of the image generation devices of the same stereo pair which the stereo image pair records or has recorded, and due to the fact that the image generation devices observe the same image object or the same portion of the image object from different viewing angles, a triangle is obtained in the captured space outside the rail vehicle. For example, correspondences of pixels in the two images of the same stereo image pair are formed. Embodiments of stereoscopic methods for obtaining depth information are known per se and will therefore not be described here in more detail. In particular, it is thus possible, and is preferably also carried out in this way in embodiments of the present invention, that depth positions are calculated for a plurality of image objects captured by the stereo image pairs. In particular, the depth position is based on a reference point of the stereo pair, which is located, for example, in the center between the two image generation devices of the stereo pair.

The first stereo pair is preferably designed and/or used to capture image objects, and optionally the depth positions thereof, which have a greater depth than image objects that are/were captured by the second stereo pair. The first stereo pair is better suited for capturing objects having greater depths since the distance of the image generation devices of the first stereo pair is greater than the distance of the image generation devices of the second stereo pair. In particular, the image generation system may be appropriately designed in that the centers of the images captured by the first stereo pair coincide at a larger depth position in a shared point in space than in the case of the second stereo pair.

In other words, the first shared portion of the space captured by the first stereo pair is predominantly located at larger depth positions than the second shared portion of the space captured by the second stereo pair. This is already achieved, for example, in that the distance of the image generation devices of the first stereo pair is greater than that of the second stereo pair, and optionally the viewing angle difference of the first stereo pair, based on the centers of the images, is equal to the viewing angle difference of the second stereo pair, based on the centers of the images. The viewing angle difference is the deviation of the viewing angle from the viewing angle of the other image generation device of the same stereo pair. The differing depth orientation, however, is also achieved with embodiments deviating from these equal viewing angle differences. For example, the viewing angle difference of the first stereo pair can be smaller than that of the second stereo pair. As an alternative or in addition, the aperture angle of the spatial regions captured by the image generation devices of the first stereo pair can be smaller than that of the second stereo pair.

It is preferred that the first stereo image pairs, which is to say the images generated by the image generation devices of the first stereo pair, and the second stereo pairs, which is to say the images generated by the image generation devices of the second stereo pair, are initially evaluated independently of one another (however, in particular, in the same processing unit), and depth information is obtained in this way. For example, the depth information is the depth position of at least one object outside the vehicle. Furthermore, it is preferred that the depth information obtained from the first stereo image pairs is compared to the depth information obtained from the second stereo image pairs. For example, depth positions are compared, which were determined both by evaluating the first stereo image pair and the second stereo image pair for the same object. The object can, in particular, be a road user, such as a motorized road vehicle or a pedestrian. Furthermore, it is preferred that pieces of information about a movement of an object captured by the first stereo pair and the second stereo pair are ascertained both from a chronological sequence of consecutively recorded first stereo image pairs and from a sequence of consecutively recorded second stereo image pairs, for example by repeatedly determining the depth position of the object, and preferably by additionally determining the position transversely to the depth direction. The result of such a determination of the movement of the object can be an impending collision with the rail vehicle, for example. Another result can be that the object does not collide with the rail vehicle. To establish the result, it is possible, in particular, to extrapolate the movement ascertained from the respective sequence of stereo image pairs, for example into the future.

In particular, it can be ascertained by comparing the results of the evaluation of the first stereo image pair and of the evaluation of the second stereo image pair whether the results agree or at least agree within (in particular predefined) tolerance boundaries. For example, a tolerance in the depth direction is predefined for the deviation of the depth position of an object ascertained from the first and second stereo image pairs, by which the depth positions of the same object ascertained from the first and second stereo image pairs are allowed to deviate from one another. In this way, for example, inaccuracies in the determination of the depth positions are considered. If the depth positions deviate from one another by more than the predefined tolerance, which is to say if the depth position from one of the stereo image pairs is outside the tolerance range of the depth position from the other stereo image pair, it is decided that the results do not agree with one another. This can, in particular, by interpreted as an indication of an error in the image acquisition and/or image evaluation of one of the two stereo image pairs. When determining movements from sequences of the stereo image pairs, the procedure can take place accordingly and, for example, a tolerance can be predefined for the position of an object in the captured space outside the rail vehicle. The position is, in particular, determined by the depth position, and additionally by two position values transversely to one another and transversely to the depth direction. A comparison becomes possible since the first shared portion of the space captured by the first stereo pair and the second shared portion of the space captured by the second stereo pair have a shared spatial region. In other words, the first and second shared portions of the space overlap or, in a special case, they are identical.

In particular, the four image generation devices are disposed in a front region of the rail vehicle in such a way that the shared spatial region is located ahead of the rail vehicle in the driving direction while the rail vehicle is traveling. This also includes instances in which the shared spatial region is located next to the route which the rail vehicle still has to travel. These spatial regions next to the route are of interest, in particular for the prediction as to whether other road users or objects can collide with the rail vehicle.

Due to the shared spatial region, the first stereo pair and the second stereo pair overall do not capture as large a portion of the outside space as possible. Rather, it is an advantage of the shared spatial region that the aforementioned comparisons are possible. Even in the event of complete failure of one of the stereo pairs, which is to say when two of the four image generation devices have failed or are faulty, and either first or second stereo image pairs are not available, a continued operation of the rail vehicle is possible using the stereo image pairs of the stereo pair that is still functional. In this case, the rail vehicle can, in particular, be operated in an operating mode in which operation, and in particular driving operation, is subject to restrictions. Such restrictions, however, may also apply even though two stereo image pairs are still available but the ratio of the distances of the image generation devices of the associated stereo pair is unfavorable. In this operating mode, for example, the maximum driving speed of the rail vehicle may be lower compared to the operating mode using two functional stereo pairs. The shared spatial region is thus, in particular, selected in such a way, which is to say the image generation devices are designed and/or oriented in such a way, that the portions of the outside space required for operating the rail vehicle or a driver assistance system are located in the shared spatial region. In the case described hereafter, this is, for example, the portion of the outside space located ahead of the rail vehicle in the driving direction, with the exception of a short section, for example several 10 cm deep, which starts directly at the front of the rail vehicle. Due to the distance of the image generation devices from one another, this short section is not captured when, as is preferred, the image generation devices are disposed directly at the front of the rail vehicle, on the inside or outside. "Inside" or "outside" in this instance shall mean that the entry surface of the respective image generation device, through which the radiation enters by way of which the image generation device captures the outside space, is located inside or outside the enveloping surface of the rail vehicle without image-generating device. A location of the surface exactly on the enveloping surface is considered to be located inside.

The image acquisition devices are preferably digital cameras, which in particular generate sequences of digital images. However, scanning recording methods in which the image elements of each of the two-dimensional images are consecutively captured in rapid succession so as to obtain the overall information of the image are also possible. Furthermore, it is optionally possible to irradiate the space to be captured and to capture the radiation reflected to the image generation device. Additionally, the captured radiation is not limited to radiation visible to humans. Rather, as an alternative or in addition, radiation in other wavelength ranges can also be captured. It is also possible to capture sound waves. However, it is preferred that at least visible radiation is also captured by the image generation devices.

The acquisition of the space, or of a portion of the space, ahead of the rail vehicle in the driving direction, using the image generation system, can be implemented by a driver assistance system, in particular on board the rail vehicle. In the case of a driverless rail vehicle, the acquisition allows remote monitoring and/or remote control of the rail vehicle, as is described in more detail hereafter with respect to the third measure.

The second measure, which is proposed hereafter to increase the reliability in the use of an image generation system, relates to the processing and/or transmission of image information generated by the image generation devices. As mentioned, this second measure can also be employed when the number of image generation devices present or operated is not four, of which two at a time form a stereo pair. It is the object of the second measure to provide a rail vehicle and/or a method for operating a rail vehicle, wherein the reliability in the use of an image generation system is increased, in particular for autonomous, driverless operation. The second measure, however, can also be employed when only at least one driver assistance system utilizes the image generation system.

A basic idea of the second measure is that the image information generated by the image generation system is processed and/or transmitted using redundantly present devices.

In particular, it is proposed that the image generation system comprises a first processor unit and a second processor unit, which are each connected via image signal links to each of the four image generation devices, wherein the first processor unit and the second processor unit are designed to calculate, independently of one another, depth information about a depth of image objects, which was captured by way of the two-dimensional images by the first stereo pair and/or the second stereo pair, during operation of the image generation system from image signals received via the image signal links, wherein the depth extends in a direction transversely to an image plane of the two-dimensional images.

This corresponds to one embodiment of the operating method in which the first through fourth image generation devices transmit image signals via image signal links both to a first processor unit of the rail vehicle and to a second processor unit of the rail vehicle, and the first processor unit and the second processor unit, independently of one another, calculate depth information about a depth of image objects, which was captured by way of the two-dimensional images from the first stereo pair and/or the second stereo pair, from the image signals, wherein the depth extends in a direction transversely to an image plane of the two-dimensional images. If, due to the failure or the fault of one of the image generation devices, only three of the four image generation devices generate and supply images, the image signals of these three image generation devices are transmitted both to the first processor unit and to the second processor unit.

Expressed in more general terms for an image generation system that comprises at least one image generation device, the image generation device or devices is or are connected via image signal links both to a first processor unit of the rail vehicle and to a second processor unit of the rail vehicle and, during operation, transmit image signals both to the first and to the second processor unit. The two processor units process the image information thus obtained independently of one another. In the event of a failure of a signal link or one of the processor units, in this way continued operation is made possible, using the image processing results. In the case of an image generation system comprising at least one stereo pair, depth information can thus be obtained and utilized despite the failure. This is important for driverless operation of the rail vehicle.

The first and second processor units can be disposed in a shared housing or at a distance from one another in the rail vehicle. In any case, it is advantageous that the processor units evaluate the same image information independently of one another.

Preferably, a comparison of the results of the processed image information obtained by the two processor units is carried out during operation of the two processor units. In the event of deviations, a decision can be made that the function of at least one of the processor units or the image information received from the processor units is faulty. As an alternative or in addition, the processor units can be used to monitor the respective other processor unit and/or the individual image generation devices of the image generation system for proper function. In particular, plausibility checks can be carried out as to whether the function and/or information satisfy plausibility criteria.

In particular the use of redundant processor units allows secure and reliable transmission of pieces of information from the rail vehicle to a remote device, such as a vehicle control center. As an alternative to a vehicle control center, the information can be transmitted from the rail vehicle to another rail vehicle, for example, such as a rail vehicle operated, in particular driving, in the same railway network and/or track section. These operating modes (such as control center operation) will be addressed in more detail hereafter. Regardless of whether redundant processor units are used, all functions and features of a control center described in the present description can be implemented alternatively or additionally by the further rail vehicle. For example, the unprocessed or further processed pieces of image information of the image generation system can be transmitted to the control center and/or the further rail vehicle.

For example, the further rail vehicle can be a vehicle following on the same track. In particular if needed, for example when autonomous operation of the first rail vehicle comprising the image generation system is not possible, or conditionally possible, and/or monitored, the following vehicle can form an actual train (which is to say the rail vehicles are mechanically coupled to one another) or a virtual train (which is to say the rail vehicles are not mechanically coupled to one another, but move as if they were coupled to one another) together with the preceding, first rail vehicle. In both instances, the driver can control the train in the following vehicle, and in particular can control the driving operation. On an image display device, which can include one or more monitors, the driver observes the image information received from the first rail vehicle, and optionally image information further processed therefrom in the following rail vehicle.

In particular in combination with redundant processor units within the rail vehicle, as described above, but also when a single processor unit is present for processing the image information generated by the image generation system, and even if the image information generated by the image generation system is not further processed inside the rail vehicle, a redundant transmission of image information from the rail vehicle to the remote device is preferred. Two transmitters for transmitting image signals to a receiver remote from the rail vehicle are thus proposed. In particular, the rail vehicle can comprise a first processor unit and a second processor unit, which are each connected via image signal links to each of the four image generation devices, wherein the first processor unit is connected to a first transmitter for transmitting image signals to a receiver remote from the rail vehicle, and the second processor unit is connected to a second transmitter for transmitting image signals to the receiver remote from the rail vehicle.

This corresponds to one embodiment of the operating method in which a first processor unit and a second processor unit of the rail vehicle each receive image signals from each of the four image generation devices via image signal links, wherein the first processor unit transmits image signals via a first transmitter to a receiver remote from the rail vehicle, and wherein the second processor unit transmits image signals via a second transmitter to the receiver remote from the rail vehicle.

The remote receiver preferably comprises two receiving units, which are each connected to one of the transmitters of the rail vehicle. The links between the transmitters and the receiver are, in particular, wireless links, and preferably broadband wireless links, such as according to the mobile radio standard LTE or the mobile radio standard UMTS. Preferably, the remote receiver or a device associated therewith checks whether the image signals transmitted from the first and second transmitters of the rail vehicle, and optionally additionally transmitted pieces of information, are complete and/or agree in terms of the information content thereof. If significant deviations or incompleteness exist, a decision can be made that the operation of the rail vehicle and/or the transmission of information to the remote receiver are faulty. Image signals shall also be understood to mean that these are processed image signals, which were processed in particular by the processor units. However, as an alternative or in addition, it is also possible for image signals not processed by the processor units to be transmitted to the remote receiver, and in particular such image signals which were received by the processor units directly from the image generation system.

The transmission links operated via the first transmitter and the second transmitter can be wireless links of the same radio network. Alternatively, however, different wireless networks are utilized for transmission.

The redundancy with respect to the transmitters and receivers, and also the signal links, allows reliable operation and/or reliable monitoring of the rail vehicle. In particular, operation of the rail vehicle controlled from a remote control center and/or a further rail vehicle becomes possible. This will be addressed in more detail hereafter.

The object of the third measure is to be able to operate a rail vehicle in a driverless manner as reliably as possible. A driver shall be understood to mean a person who rides along on the rail vehicle when the vehicle is moving and controls the driving operation of the rail vehicle, in particular with respect to traction and braking of the rail vehicle.

It is proposed to control the driving operation of the rail vehicle automatically, and thus in a driverless manner, using the image information generated by an image generation system of the rail vehicle. In particular, possible collisions of the rail vehicle with obstacles of any kind are recognized by means of the image generation system, and an intervention in the control of the driving operation takes place automatically depending on the recognition of an impending collision. In addition, it is proposed to transmit the image information generated by the image generation system and/or to transmit processed image information that has been generated from the image information by at least one device of the rail vehicle to a remote control center. The transmission can take place continuously and permanently during driving operation. Alternatively, the transmission can take place when automatic driving operation is not possible solely by way of devices of the rail vehicle and/or when such autonomous driving operation of the rail vehicle is faulty, or at least an indication of a fault exists. Furthermore, it is possible that a control center, which is disposed remotely from the rail vehicle, requests the transmission of the image information from the rail vehicle and thereby triggers the transmission. This allows the control center, and in particular a person working therein, to monitor the autonomous operation of the rail vehicle, in particular also when no fault, and also no indication of a fault, exists.

In particular, the above-described first measure and/or second measure increase the reliability and safety of autonomous operation, of the monitoring process, and possibly of an operation of the rail vehicle remotely controlled from the control center. However, the third measure can also be implemented without the first and second measures.

In particular the following is proposed: a system for operating a rail vehicle, and in particular a rail vehicle in one of the embodiments described in the present description, wherein the system comprises the rail vehicle and a control center which is remote from the rail vehicle. By way of the control center, the aforementioned remote-controlled driving operation of the rail vehicle and/or monitoring of the autonomous driving operation of the rail vehicle can be carried out. The rail vehicle preferably comprises a first transmitter, via which, during an operation of the rail vehicle, image signals from each of the four image generation devices and/or further processed image signals generated by a processor unit of the rail vehicle from the image signals are transmitted to a first receiver remote from the rail vehicle, wherein the control center is connected to the first receiver and, during an operation of the rail vehicle, receives image signals received by the receiver, wherein the control center comprises an image display device, which during an operation of the rail vehicle generates images from the received image signals and displays these, wherein the control center comprises a control device, which during the operation of the rail vehicle generates control signals for controlling a driving operation of the rail vehicle, wherein the control center is connected to a second transmitter, via which, during the operation, the control signals are transmitted to a second receiver of the rail vehicle, and wherein the rail vehicle comprises a driving system, which during the operation of the rail vehicle receives and processes the control signals generated by the control device of the control center and carries out the driving operation of the rail vehicle in keeping with the control signals.

A corresponding embodiment of the operating method likewise refers to a system, comprising the rail vehicle in one of the embodiments described herein and a control center remote from the rail vehicle, wherein, during an operation of the rail vehicle, image signals from each of the four image generation devices and/or further processed image signals generated by a processor unit of the rail vehicle from the image signals are transmitted from a first transmitter of the rail vehicle to a first receiver remote from the rail vehicle, wherein the control center receives image signals received by the first receiver, wherein the control center generates images from the received image signals by way of an image display device and displays these, wherein the control center generates control signals for controlling a driving operation of the rail vehicle by way of a control device, wherein the control center transmits the control signals via a second transmitter to a second receiver of the rail vehicle, and wherein a driving system of the rail vehicle receives and processes the control signals from the second receiver and carries out the driving operation of the rail vehicle according to the control signals.

Instead of the four image generation devices, of which at least three form the first and the second stereo pairs, the image generation system of the rail vehicle can comprise a different number of image generation devices, the image information of which is further processed by at least one processor unit of the rail vehicle and/or the image information of which is transmitted without processing from the first transmitter to the first receiver remote from the rail vehicle.

The third measure in particular has the advantage that onward travel of the vehicle in some instances, despite an obstacle that blocks, or appears to block, the route, is possible by way of a driving operation remotely controlled by the control center and/or by the further rail vehicle. This is based on the finding that there are obstacles that are erroneously categorized as insurmountable by an automatic and autonomous driving system of the rail vehicle. Examples include light-weight but bulky objects such as sheeting used at construction sites, for example. It is also possible that an obstacle, when slowly approached by the rail vehicle, voluntarily or independently leaves the route, such as an animal. In particular in these cases, for example, a person working in the control center is able to discern images displayed on the image display device which are based on the image information of the vehicle image generation system. Furthermore, the person can control the driving operation of the rail vehicle via the control device of the control center. Even if the autonomous vehicle control on board the rail vehicle is faulty, the driving operation can be controlled by the control center. If at least one stereo pair is functioning without faults and the, possibly further processed, image information generated therefrom is transmitted without faults, it is possible for the control center to receive and evaluate depth information about the spatial region ahead of the rail vehicle in the driving direction. Optionally, the depth information is generated from the respective stereo image pair only when received in the control center. A person in the control center, similarly to a driver of a conventional rail vehicle, can thus base his or her control commands for controlling the driving operation on more than just two-dimensional image information.

The control center and/or the further rail vehicle comprise in particular an image display device for displaying image information, which was obtained utilizing the image generation system. If stereo image pairs or image information derived therefrom, comprising an associated image or a respective associated sequence of images for the eyes of an observing person, is or are available, the image display device, for example, can comprise a monitor or an arrangement of monitors. The image display device is preferably combined with an optical device, or comprises the same, which allows the observation of the individual images solely or predominantly through the associated eye of the observer, for example by way of suitable pinhole aperture and/or lenses. In particular, such a unit worn on the head of the observer may also be used as the image display device. In this way, the observer is able to realistically discern the space captured by the image generation system with his or her eyes.

When image information from the two stereo pairs is available, the integrity and/or correctness of the images displayed in the control center and/or the further rail vehicle can be validated, for example by way of a plausibility check and/or a comparison of image information and/or information derived therefrom.

The at least one image generation device of the image generation system of the rail vehicle is, in particular, a device comprising an optical system (which is to say an optical device), by way of which the captured radiation incident upon the device is deflected to a sensor, which generates the image information, such as digital, two-dimensional image information.

For discerning the space outside the rail vehicle, regardless of whether the information is used by a driver assistance system on board the rail vehicle, by an autonomous driving system of the vehicle and/or by a control center, optionally not only an image generation system is used, which generates two-dimensional images of the space outside the rail vehicle, but additionally at least one further sensor is utilized, which captures the surroundings of the vehicle. In particular, laser sensors, radar sensors and ultrasonic sensors can be used for this purpose. As an alternative or in addition to the at least one image generation device, which captures the space ahead of the rail vehicle in the driving direction, at least one of the aforementioned additional sensors and/or at least one further image generation device, which generates two-dimensional images, in particular by way of an optical system, can capture spatial regions sideways of the rail vehicle and/or in the driving direction behind the rail vehicle. In this way, all pieces of information necessary for the driving operation or the further operation of the rail vehicle (such as monitoring passengers entering and exiting) can be captured.

Image generation devices and/or other sensors of the rail vehicle for capturing the space outside the rail vehicle and/or signal generators for outputting signals into the space outside the rail vehicle can, in particular, be at least partially disposed in a protrusion on the outer surface of the rail vehicle which has a beam shape. At least one sensor and/or one signal generator can thus be at least partially disposed in the beam-shaped protrusion. In particular, a rail vehicle comprising a sensor for capturing a space outside the rail vehicle and/or comprising a signal generator for outputting signals into the space outside the rail vehicle is also proposed, wherein the rail vehicle on the outer surface thereof comprises a beam-shaped protrusion, in which at least a portion of the sensor and/or signal generator is disposed.

One advantage of the beam-shaped protrusion is that the design of the rail vehicle requires only minor modifications compared to an embodiment without beam-shaped protrusion. All parts of the rail vehicle located inside the outer shell of an existing rail vehicle structure can be implemented as before. For a beam-shaped protrusion, which is additionally provided on the outer surface of the rail vehicle, attachment regions for attaching the beam-shaped protrusion and for feeding through at least one connecting line of the sensor and/or signal generator can be found in a simple manner. The beam-shaped elongated design of the protrusion allows attachment points and feedthroughs to be freely positioned within sections of the protrusion.

A beam-shaped protrusion moreover has the advantage that space for arranging the at least one sensor and/or signal generator is available, which does not take up, or only moderately takes up, the space located inside the protrusion in the outer shell of the rail vehicle. Furthermore, a larger portion of the outside space can be captured in an unobstructed manner from a protrusion on the outer surface of the rail vehicle, or signals can be transmitted in an unobstructed manner into a larger portion of the outside space, than in the case of an arrangement within planar surface regions of the rail vehicle, or surface regions of the rail vehicle not provided with a protrusion. The position of the sensor is thus favorable for capturing the outside space, and the position of the signal generator is favorable for emitting signals into the outside space. For example, nothing is in the way of capturing the outside space and/or for emitting signals in the vertical direction, or approximately vertical direction, down to the ground directly adjacent to the rail vehicle. This is advantageous, in particular, for a projection of light, but also for capturing persons standing, or objects lying, directly adjacent to the rail vehicle. In addition, the beam-shaped protrusion protects the sensor and/or signal generator from outside influences. In particular, forces acting from the outside (such as trees located next to the travel track) can be absorbed by a section of the beam-shaped protrusion and dissipated before they are able to act on the sensor and/or signal generator. The beam-shaped protrusion, however, also protects against other outside influences such as dirt, precipitation and moisture and/or solar radiation.

The signal generator can, in particular, be an acoustic signal generator for outputting an acoustic signal (such as a warning) and/or an optical signal generator for outputting an optical signal. An optical signal, in particular, shall also be understood to mean light discernible by persons, which can impinge on a projection surface, such as a road surface, for example, so that, in particular, symbols and/or images that are visually discernible are projected on the projection surface. In the case of the projection, the optical signal generator can thus be referred to as a projector.

In particular, the beam-shaped protrusion extends in a longitudinal direction, which is the direction of the largest outside dimension of the beam-shaped protrusion, wherein the longitudinal direction extends transversely to the vertical direction along the outer surface of the rail vehicle. In particular, the longitudinal direction can follow the outer contour of the rail vehicle. In this case, the longitudinal direction can, in keeping with the outer contour, have an angled progression (for example at the transition between side walls of the rail vehicle disposed in an angled manner with respect to one another) and/or a curved progression (for example at the curved side walls of the rail vehicle).

The beam-shaped protrusion can be implemented in a variety of ways. As a separate component, the beam-shaped protrusion can be attached to the outer surface of a rail vehicle car body, such as by way of welding, glueing, riveting and/or bolting. As an alternative or in addition, a form-locked joint is possible when the outer surface of the car body is appropriately configured, for example provided with a profile extending in the longitudinal direction of the beam-shaped protrusion to be attached, the beam-shaped protrusion then being attached to the profile. As an alternative, the beam-shaped protrusion can be designed as an integral part of the car body or of the roof of the rail vehicle.

The cross-sectional profile of the beam-shaped protrusion is preferably constant in terms of the shape and size of the cross-section, in particular with the exception of the end regions at the opposite ends in the longitudinal direction of the protrusion and/or with the exception of the region in which the sensor and/or signal generator are located. In regions in which the progression of the beam-shaped protrusion is angled in the longitudinal direction, for example so as to conform to the outer contour of the rail vehicle, the shape and/or size of the cross-section can deviate from the otherwise constant cross-section. A preferred cross-sectional shape is trapezoidal, wherein the longer side of the parallel sides of the trapezoid is located on the inside and, for example, is connected to the outer surface of the car body, and the shorter side of the parallel sides of the trapezoid is located on the outside. In this case, but also in the case of other cross-sectional shapes (such as a triangular or a round, and in particular semi-circular, cross-sectional shape), the protrusion tapers from the inside to the outside, as viewed in the cross-section. This has the advantage that a stable attachment of the protrusion is simplified, and objects, such as tree branches or twigs next to the route, do not get caught on the protrusion, and also do not become stuck.

Materials that can be used for the protrusion include, in particular, profiled sheet sections made of metal or plastic material, such as polypropylene or other polymers, which are angled in keeping with the cross-sectional shape. Due to the strength and low weight of fiber-reinforced plastic materials, these are also well-suited.

In particular, the material of the beam-shaped protrusion forms at least one outer wall extending in the longitudinal direction of the protrusion, the outer wall delimiting an inside space of the beam-shaped protrusion from the outside space of the protrusion and of the rail vehicle. In this way, preferably an elongated housing is formed, wherein an inside space or cavity of the beam-shaped protrusion extends in the longitudinal direction of the protrusion. It is preferred that the cavity extends continuously, without being sealed and bulkheaded off into different longitudinal sections, from the one end region of the beam-shaped protrusion to the opposite end region of the beam-shaped protrusion. However, this does not preclude different beam-shaped protrusions from abutting at the end regions thereof. Alternatively, it is possible for long beam-shaped protrusions, for example extending across several meters in length in the longitudinal direction, to be divided into longitudinal sections that are bulkheaded off from one another. Cavities extending continuously in the longitudinal direction, but also apertures through bulkheads between separate longitudinal sections of the beam-shaped protrusion allow at least one connecting line for connecting the sensor and/or the signal generator electrically and/or for signaling purposes to be run in the longitudinal direction of the protrusion (which is to say the at least one connecting line extends in the longitudinal direction). If multiple connecting lines are present and/or multiple sensors and/or signal generators are disposed in the beam-shaped protrusion with at least a portion of the volumes thereof, the connecting lines can be routed in the manner of wiring harnesses as wiring bundles in the beam-shaped protrusion. For example, the bundle is introduced at a single transition point from the inside space of the beam-shaped protrusion into the interior of the rail vehicle.

In particular, the beam-shaped protrusion can extend along an outer circumferential line, which, as viewed from above, extends around the rail vehicle. The beam-shaped protrusion preferably extends along side walls of a rail vehicle car body and/or around a front region of the rail vehicle. In the regions in which the beam-shaped protrusion is located, the protrusion is raised, in particular, laterally (for example in the horizontal direction), toward the front or toward the back (depending on the location of the region) over the outer surface of the vehicle. A longer beam-shaped protrusion has the advantage that it offers room for sensors and/or signal generators in various regions of the outer surface and, in contrast to multiple beam-shaped protrusions that are spaced apart from one another, has fewer end regions against which objects could bump. This also offers the option of accommodating connecting lines of the sensors and/or signal generators across the entire longitudinal extension of the protrusion or at least a portion thereof.

Other devices of the rail vehicle, and in particular guides for guiding the movement of doors, can also be integrated in the protrusion.

In particular, the beam-shaped protrusion can extend continuously around the rail vehicle in the manner of a ring. This makes it possible to dispose sensors and/or signal generators in arbitrary positions in the circumferential direction of the vehicle.

The beam-shaped protrusion preferably extends above an outside window or above outside windows of the rail vehicle. In the region above windows, sensors have a good position to capture the space outside the rail vehicle, and signal generators have a good position to emit signals. Additionally, persons do not come in contact with the protrusion, for example when entering and exiting, due to the large height of the region above windows.

By evaluating at least one stereo image pair, and in particular by evaluating a chronological sequence of the stereo image pairs generated by at least one stereo pair of image generation devices, it is possible to obtain more than just depth information of objects on or at the route. As an alternative or in addition, the progression of the travel track can be ascertained. This makes it possible, for example, to control the operation of the rail vehicle with respect to at least one further function. Possible further functions are, for example, the orientation of wheels (in particular, in keeping with the curve radius of a curve of the travel track) of the rail vehicle on which the rail vehicle runs, and the orientation or activation (such as switching on) of at least one headlight (in particular, in keeping with the progression of a curve of the travel track and/or a preceding and/or following straight travel track section or a curve having a different radius of curvature).

BRIEF DESCRIPTION OF THE DRAWINGS

Exemplary embodiments of the invention will be described hereafter with reference to the accompanying drawings. The exemplary embodiments described based on FIGS. 1 to 10 comprise only sensors. However, it is possible to replace at least one of the sensors with a signal generator and/or to dispose at least one signal generator, in addition to the sensors, at least partially in the beam-shaped protrusion. The individual figures in the drawings show.

DETAILED DESCRIPTION OF THE INVENTION

Figure 1:
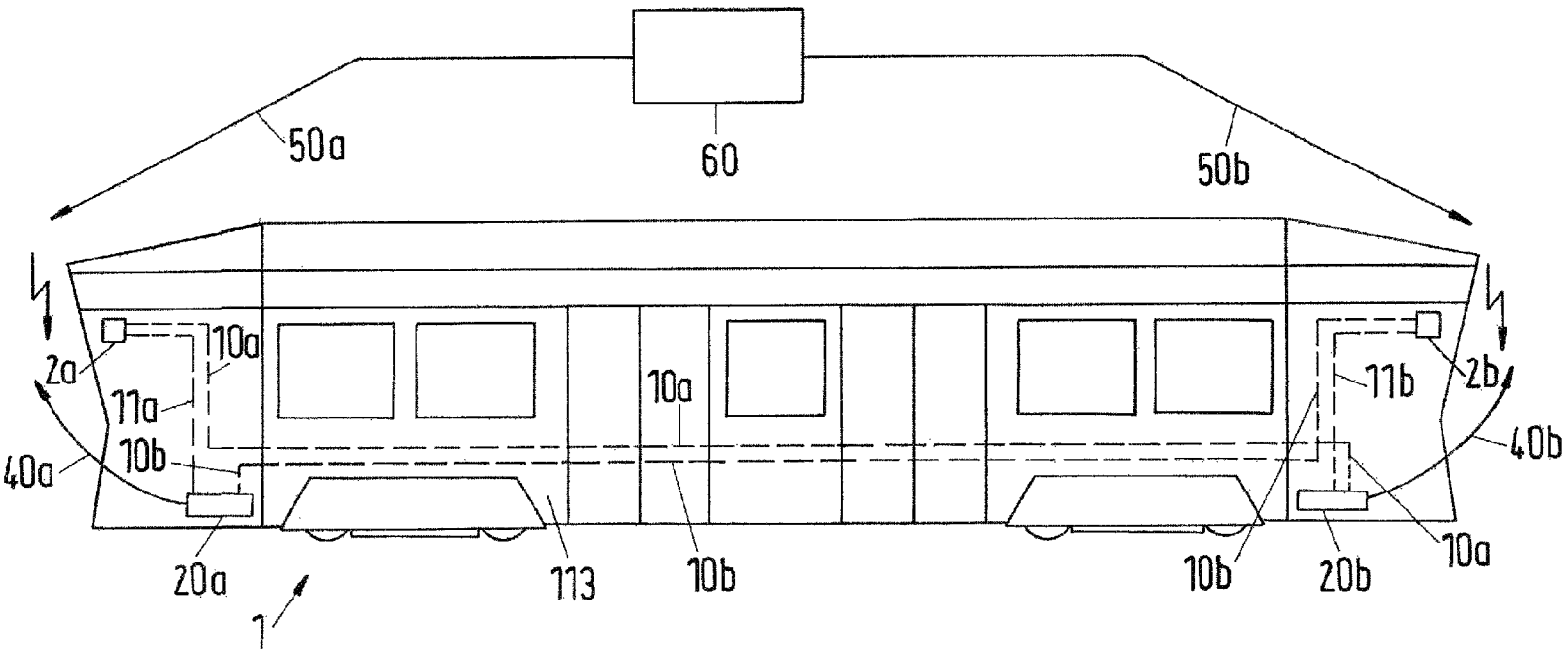
FIG. 1 shows a side view of a rail vehicle, for example of a streetcar or city rail vehicle, wherein devices of the rail vehicle are schematically illustrated, which are connected via a wireless link to an external control center.

The rail vehicle 1 shown in FIG. 1 comprises a front region in the left of the figure and a rear region in the right of the figure. However, it is also possible that the vehicle 1, during normal operation, can drive in the opposite driving direction, for example when a driver's cab is likewise present in the end region shown on the right, or when at least all devices required for driving to the right, such as headlights, are present.

A respective image generation system, comprising at least one image generation device, and preferably the at least four aforementioned image generation devices, is located in the two end regions shown on the left and right of FIG. 1. An image generation device 2*a* of a first image generation system is illustrated in the left end region, and an image generation device 2*b* of a second image generation system is shown in the right end region. These two image generation systems each capture the outside space of the vehicle 1 located ahead of or behind the end region. The image generation devices 2*a*, 2*b* are digital cameras, for example, which continuously generate two-dimensional images of the outside space.

The image generation devices 2 of the first and second image generation systems are each connected to a first processor unit 20*a* and a second processor unit 20*b* via image signal links 10*a*, 10*b*; 11*a*, 11*b* that are separate from one another. The first processor unit 20*a* is disposed in the left end region or an adjoining center region of the vehicle 1. The second processor unit 20*b* is disposed in the right end region or an adjoining center region of the vehicle 1. The image signal links 10*a*, 10*b* consequently extend in the longitudinal direction or along the longitudinal direction through the vehicle 1 to the processor unit.

The processor units 20 are each combined with a transmitter, which is not shown separately in FIG. 1. The transmitter transmits image signals via a wireless link 40*a*, 40*b* to a control center 60. The wireless links are separate wireless links, preferably using different mobile communication networks, so that one of the wireless links 40*a*, 40*b* can still be operated when one of the networks fails.

Via the wireless links 40*a*, 40*b*, the pieces of image information generated by the first or second image generation system can be transmitted, without being further processed by the processor units 20*a*, 20*b* and/or in further processed form (such as using depth information of captured objects), to the control center 60. In this way, a variant of the exemplary embodiment shown in FIG. 1 is also possible, in which only one transmitter for transmitting the not further processed image information is present instead of the first processor unit 20*a* and/or only one transmitter for transmitting the not further processed image information is present instead of the second processor unit 20*b*. If at least one of the processor units 20*a*, 20*b* further processes pieces of image information, the processor unit represents at least part of an evaluation device. In contrast to what is shown in the figures, it is also possible for only a single evaluation device to be present. This evaluation devices receives, in particular, images from four image generation devices, which all four have a shared acquisition region (spatial region), which is to say at least a portion of all four acquisition regions is the same.

For the control center 60 preferably also the option exists to transmit information to the rail vehicle 1 by transmitting signals via a wireless link 50*a* and/or 50*b*. For example, the transmitters of the vehicle 1, which are combined with the first processor unit 20*a* or the second processor unit 20*b* or which are provided instead of the processor unit 20, also comprise a receiver for receiving the wireless signals from the control center 60. A signal processing device, which is not shown in FIG. 1, is connected to the wireless links 50*a*, 50*b* and can process the signals received from the control center 60 and, for example, control the driving operation of the vehicle 1.

Figure 2:
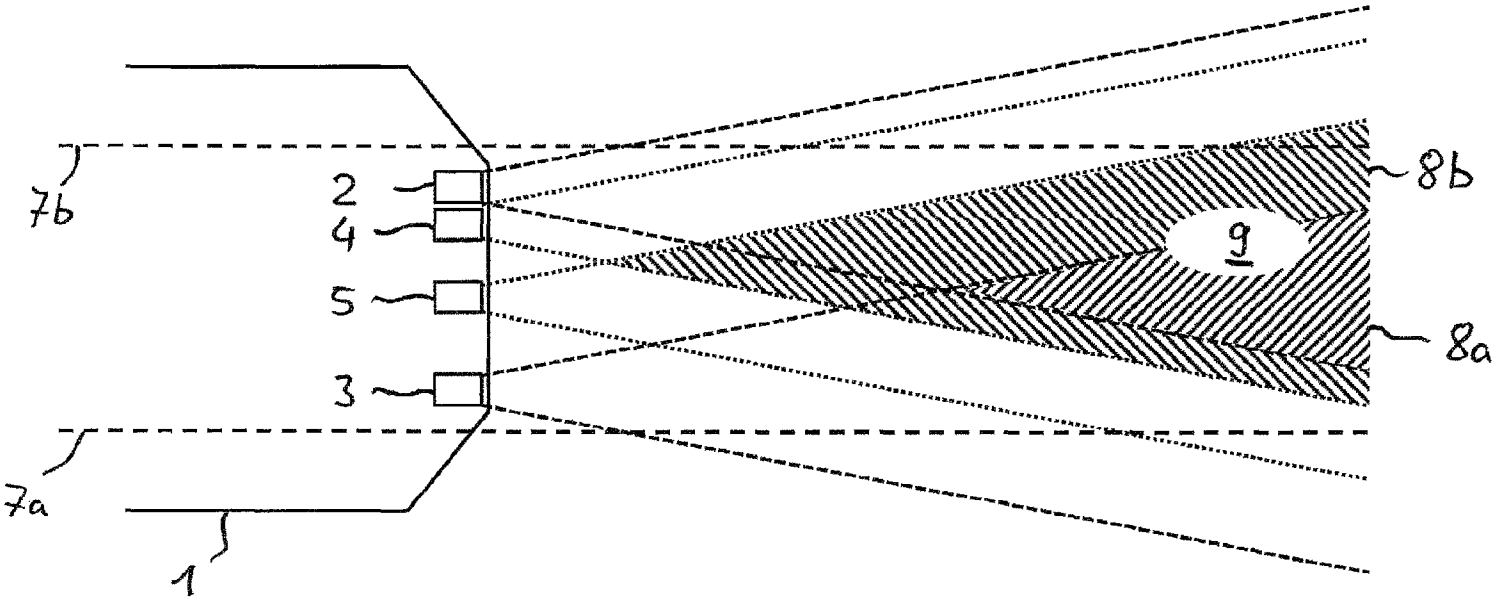
FIG. 2 schematically shows a top view onto a front region of a vehicle running on rails, comprising an image generation system, which includes two stereo pairs.

The rail vehicle 1 shown schematically in FIG. 2, which can be the rail vehicle 1 from FIG. 1, comprises an image generation system including four image generation devices 2, 3, 4, 5 in the front region thereof. The first image generation device 2 and the second image generation device 3 form a first stereo pair 2, 3 having a larger distance from one another in the horizontal device than the third image generation device 4 and the fourth image generation device 5, which form a second stereo pair 4, 5.

In the special exemplary embodiment of FIG. 2, the aperture angles of the spatial regions captured by the individual image generation devices 2 to 5 ahead of the vehicle 1 in the driving direction are equal in size. Due to the larger distance of the image generation devices 2, 3, however, the shared portion 8*a* of the space captured by the first stereo pair 2, 3 is located at a larger distance ahead of the rail vehicle 1 than the shared portion 8*b* of the space captured by the second stereo pair 4, 5.

FIG. 2 also hints at the progression of the two rails 7*a*, 7*b* by way of the dotted lines extending horizontally in FIG. 2. An oval region denoted by reference numeral 9 represents an object located ahead of the vehicle 1 in the driving direction, which is located completely in the shared portion 8*b* of the second stereo pair 4, 5, but is located only partially in the shared portion 8*a* of the first stereo pair 2, 3.

The first stereo pair 2, 3 is used to capture a spatial region located at a larger distance (which is to say in the depth direction extending from left to right in FIG. 2) than the second stereo pair 4, 5. In this way, the accuracy in the acquisition of the space located ahead of the rail vehicle 1 in the driving direction can be increased compared to the use of a single stereo pair. In contrast to what is shown in FIG. 2, the aperture angle of the first and second image generation devices 2, 3 can be smaller than the aperture angle of the third and fourth image generation devices 4, 5 and/or the spatial region captured in a sharply captured manner in the generated images can be located further away from the rail vehicle 1 in the case of the first stereo pair 2, 3 than in the case of the second stereo pair 4, 5 due to optical devices, which are not shown and combined with the image generation devices 2 to 5.

Figure 3:
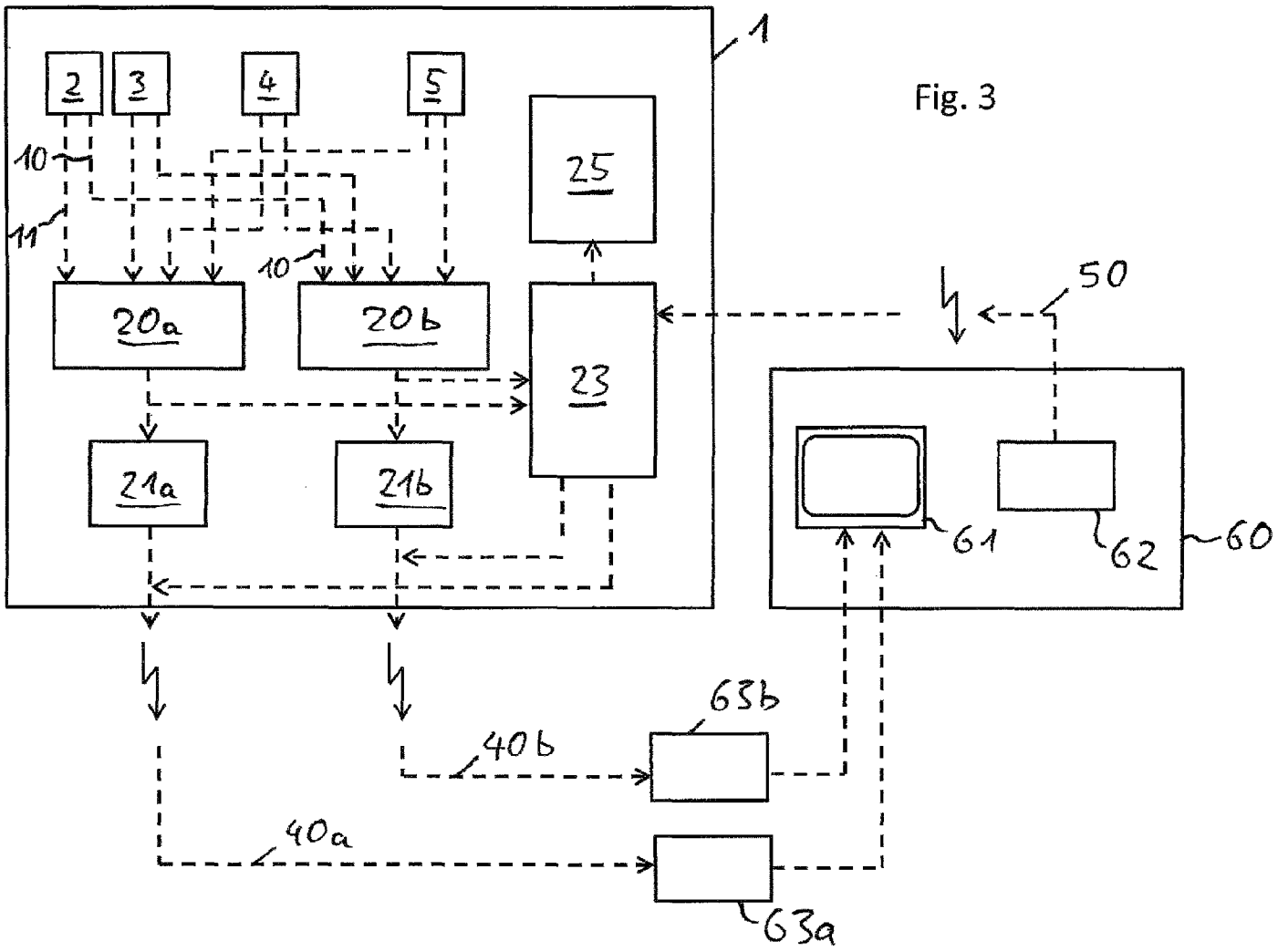
FIG. 3 shows a block diagram including devices in a rail vehicle, which are connected via wireless links to a control center.

In FIG. 3, a rectangular frame denoted by reference numeral 1 schematically shows the outer contour of a rail vehicle, for example of the rail vehicle 1 from FIG. 1 and/or FIG. 2. In FIG. 3, furthermore a rectangular frame denoted by reference numeral 60 shows the outer contour of a control center for operating at least one rail vehicle.

In the exemplary embodiment of FIG. 3, as in FIG. 2, the rail vehicle 1 comprises two stereo pairs 2, 3; 4, 5, which together form an image generation system. However, alternatively, the image generation system can comprise a different number of image generation devices. Further alternatively, while it is possible for at least the four image generation devices from FIG. 3 to be present, only three at a time are operated simultaneously (which is say during the same operating phase), and nonetheless form two stereo pairs. In any case, each of the image generation devices 2 to 5 of the image generation system is connected via a first image signal link 11 to a first processor unit 20*a*, and via a separate, second image signal link 10 to a second processor unit 20*b*.

During the operation of the image generation system, image signals are transmitted via these image signal links 10, 11 from the image generation devices 2 to 5 to the two processor units 20*a*, 20*b*. Furthermore, the two processor units 20 process the received image signals, or the image information contained therein, in the same manner, whereby, in particular, mutual monitoring of the processor units 20 and/or a comparison of the results of the processing operation become possible.

Image information further processed by the two processor units 20 and/or the not further processed image information received by the processor units 20 is transmitted in the exemplary embodiment both to a central vehicle controller 23 and to a first transmitter 21*a* and a second transmitter 21*b*, which each transmit corresponding signals containing the information via separate wireless links 40*a*, 40*b* to a receiver 63*a* or 63*b* remote from the rail vehicle 1. A first signal link 40*a* thus exists from the first transmitter 21*a* to the first receiver 63*a*, and a second signal link 40*b* exists from the second transmitter 21*b* to the second receiver 63*b*. Optionally, signals generated by the central vehicle controller 23 are additionally transmitted via the first and second signal links 40*a*, 40*b*, wherein the central vehicle controller 23 optionally uses the first and second transmitters 21*a*, 21*b* or itself comprises a first and a second transmitter.

The first and second receivers 63*a*, 63*b* are connected to an image display device 61 of the control center 60. The control center 60 furthermore comprises a control device 62, which is connected to the central vehicle controller 23 via a transmitter, which is not illustrated in detail, and a wireless signal link 50. The corresponding receiver of the signal link 50, which is part of the rail vehicle 1, can, for example, be a device that is combined with the first transmitter 21*a* or the second transmitter 21*b*, or it may be implemented, for example, as a separate receiver or a receiver integrated into the central vehicle controller 23. Optionally, a second wireless link, which is redundant with respect to the signal link 50, for transmitting signals from the control center 60 to the vehicle 1 may be provided, as is shown in FIG. 1.

One example of a preferred operation of the arrangement shown schematically in FIG. 3 is described hereafter. The image generation system of the vehicle 1 captures the space located, in particular, ahead of the vehicle 1 in the driving direction and generates corresponding two-dimensional images of the space. The image information thus generated is transmitted via the first and second signal links 10, 11 to the first and second processor units 20. If at least one stereo pair is present, each of the processor units 20*a*, 20*b* calculates depth information of the objects captured by way of the images and, optionally, additionally calculates whether a collision of the vehicle 1 with the obstacle on the route is impending. It is also possible to calculate whether an object on the route is presumed to be moving, if movement of the object continues.

The results of the calculations, and preferably at least portions of the not processed image information, which was received from the image generation system, are transmitted from the processor units 20 to the central vehicle controller 23, which controls the driving operation of the rail vehicle 1 using the information received from the processor units 20 and accordingly controls, in particular, a driving system 25, and in particular a traction and braking system, of the rail vehicle 1. In this way, autonomous, driverless operation of the vehicle 1 is possible.

Deviating from the above-described exemplary embodiment, the central vehicle controller 23 may also receive the depth information calculated by the processor units 20, but calculate potential impending collisions itself. Optionally, to further increase reliability, the central vehicle controller 23 can likewise comprise redundant processor units, which carry out all data processing operations running in the central vehicle controller 23 redundantly, which is to say separately from one another in the same manner. Alternatively or additionally, the central vehicle controller 23 can compare the pieces of information received from the two processor units 20*a*, 20*b* to one another and check whether significant deviations exist. If necessary, the central vehicle controller 23 can thus establish a fault of at least the operation of one processor unit and/or of part of the image generation system.

Optionally, the central vehicle controller 23 generates signals that are the result of the processing operation of the signals received from the two processor units 20, and transmits these signals via the first and second wireless signal links 40*a*, 40*b* to the control center 60. In any case, it is preferred that the signals output by the processor units 20 are transmitted via the first and second transmitters 21*a*, 21*b* and the first and second wireless links 40*a*, 40*b* to the control center 60.

Optionally, the image display device 61 can be combined with a processing device, which is not illustrated in detail and which processes the images to be displayed in such a way that they are represented on the image display device 61. Optionally, this processing device can check whether the signals received via the separate wireless signal links 40*a*, 40*b* significantly deviate from one another, and thus the operation is partially faulty. In particular, appropriate measures can be taken automatically in the event of a fault in that the control center 60 transmits signals to the central vehicle controller 23 via the wireless signal link 50.

In particular, at least one person in the control center 60 observes the images displayed on the image display device 61. This may be limited to time periods during which the central vehicle controller 23 is not able to control the driving operation of the vehicle 1 autonomously. By actuating the control device 62, the person can generate control signals, which are transmitted via the wireless signal link 50 to the central vehicle controller 23. In particular, the person can thus remotely control the driving operation of the rail vehicle 1. As an alternative or in addition, the person can generate only control signals for monitoring the operation of the rail vehicle 1, which are transmitted via the wireless signal link 50 to the central vehicle controller 23 and cause signals that are necessary for monitoring to be transmitted via the wireless signal link 40.

Figure 4:
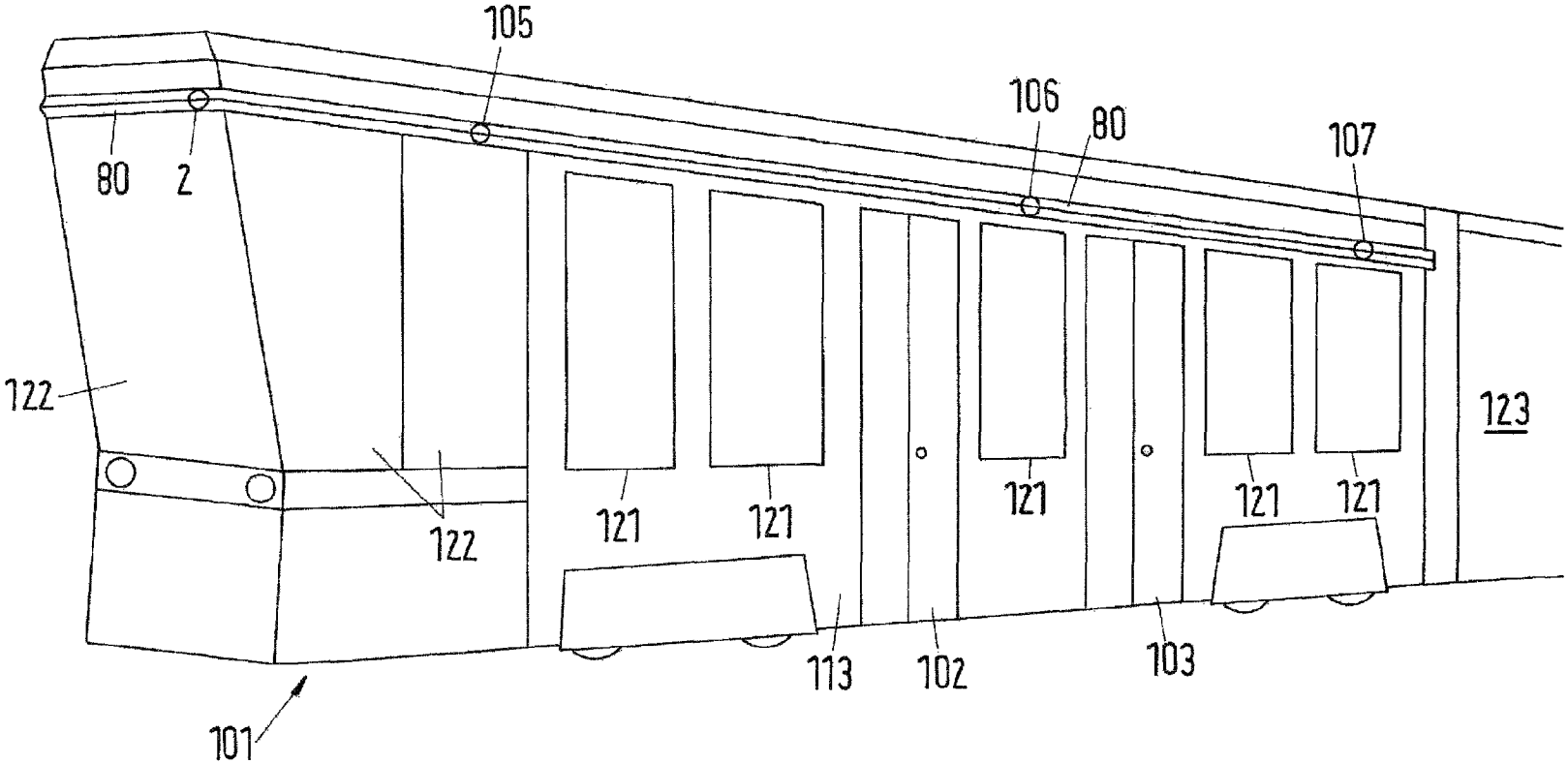
FIG. 4 shows a simplified outside view of a rail vehicle comprising a beam-shaped protrusion extending peripherally around the sides, which extends above outside windows of the rail vehicle and in which multiple sensors for capturing the outside space of the rail vehicle are disposed.

The rail vehicle 101 shown in FIG. 4 can be the rail vehicle 1 from one of FIGS. 1 to FIG. 3, for example. The vehicle comprises a beam-shaped protrusion 80, which extends above windows 121 in the side walls 113 of the vehicle 101, and also above windows 122 in the front region of the vehicle 101, and in which a plurality of sensors 2, 105, 106, 107 are integrated, or at least are integrated with part of the respective volumes thereof. In the case of the partial integration, part of the sensor can project from the beam-shaped protrusion to the outside and/or to the inside. In particular, the beam-shaped protrusion 80 can be recessed on the bottom side of the respective sensor or directly next to the respective sensor so as to allow the sensor to capture spatial regions outside the rail vehicle 101 in an unobstructed manner. The image generation device 2 of one of FIGS. 1 to 3, for example, is located in the region of the vehicle 101 shown on the left in FIG. 4, which is forwardly oriented in the driving direction, and optionally further image generation devices, which are not shown in FIG. 4, of an image generation system for capturing a spatial region ahead of the vehicle 101 in the driving direction.

Figure 5:
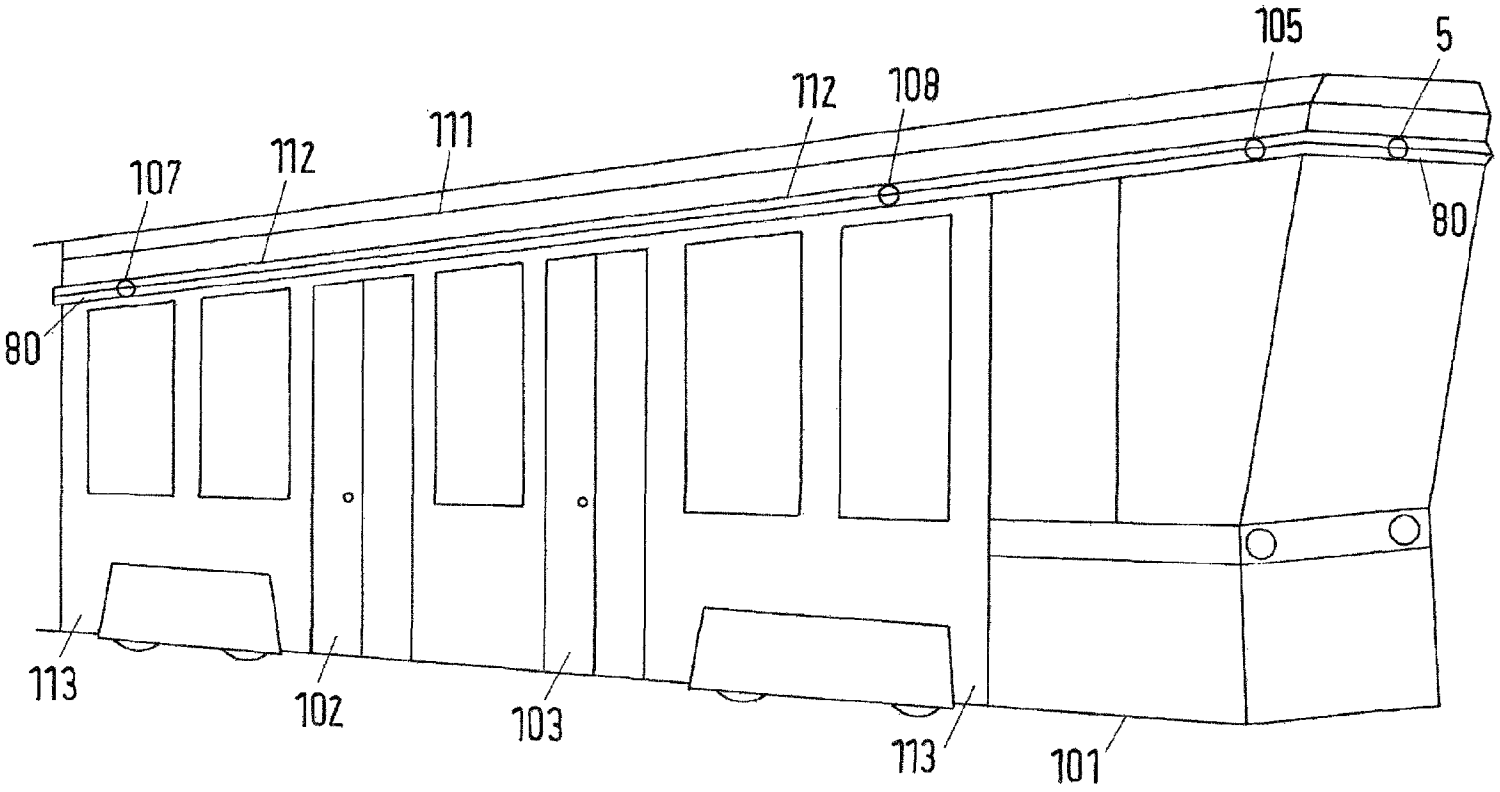
FIG. 5 shows an illustration similar to that of FIG. 4, for example of the same rail vehicle as in FIG. 4, however from the opposite side, or an illustration of a similar rail vehicle.

In the exemplary embodiment shown in FIG. 4, the beam-shaped protrusion 80, proceeding from the transition region to an abutting car body of a vehicle or vehicle part coupled to the vehicle 101 shown on the right in FIG. 4, extends along the longitudinal direction of the vehicle 101 on the side wall 113 located in the front in the image, and subsequently around the front region of the vehicle 101. As is illustrated in FIG. 5, proceeding from the front region, the beam-shaped protrusion 80 preferably extends further opposite to the longitudinal direction along the opposite side wall 113, which is shown in FIG. 5. Sensors 105, 107 and 108 for capturing the outside space of the rail vehicle 101 are also present in the section of the beam-shaped protrusion 80 shown in FIG. 5. A further image generation device 5 of the image generation system is located in the front region, looking forward in the driving direction, shown in FIG. 5. The sensors 105 that are likewise disposed in the front region, but not in the foremost part of the front region, can be radar or ultrasonic sensors, for example. The sensors 106, 107 and 108 disposed on the side walls 113 can be digital cameras, for example, which capture the region outside the vehicle, and in particular around the vehicle doors 102, 103, during stops at rail stations.

Figure 6:
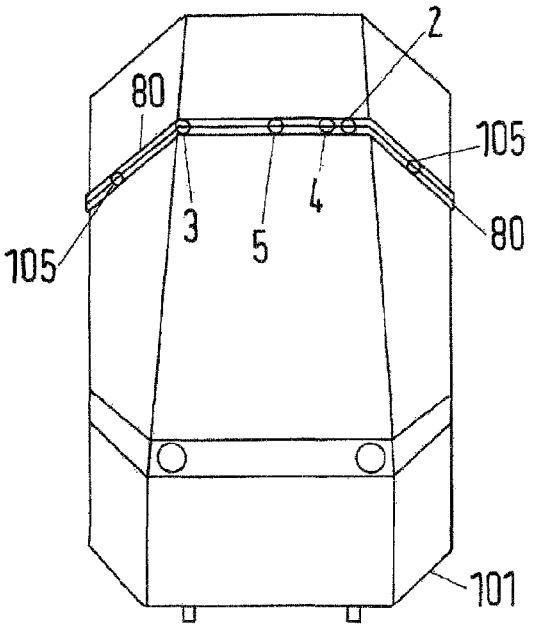
FIG. 6 shows a frontal view of a rail vehicle, comprising a beam-shaped protrusion extending from the side walls of the rail vehicle around the front, in which sensors for capturing the space outside the vehicle are disposed.

The front region of a rail vehicle 101 shown in FIG. 6, which can be the rail vehicle 101 from FIG. 4 and/or FIG. 5, likewise shows a beam-shaped protrusion 80 extending around the front region. The four image generation devices 2 to 5 are apparent, which correspond to the image generation system from FIG. 2 and FIG. 3. This example demonstrates that the four sensors 2 to 5 of the image generation system can, in particular, be disposed next to one another, and preferably disposed next to one another in the horizontal direction. The first sensor 2 and the third sensor 4 are directly juxtaposed and have the smallest possible distance (in particular zero) with respect to one another.

Alternatively, the sensors of the image generation system could be disposed not in a beam-shaped protrusion, but, for example, flush with the planar outer surface of the vehicle or, for example, behind the windshield of the rail vehicle, so that they capture the space outside the rail vehicle through the windshield. In particular when a windshield wiper is being operated, which moves back and forth across the windshield, image acquisition is repeatedly faulty. In particular when chronological image sequences are captured, such impairing effects can be corrected by way of image evaluation software and/or hardware, for example.

Figure 7:
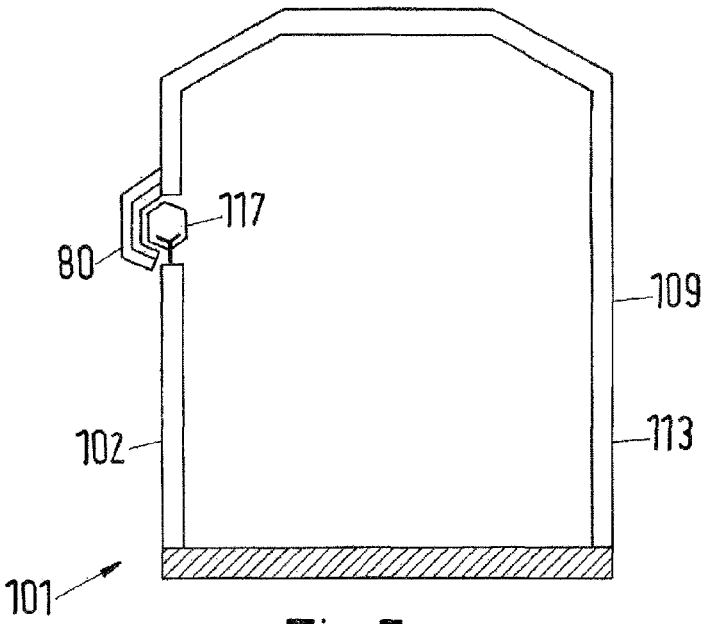
FIG. 7 schematically shows a cross-sectional view through a car body of a rail vehicle, wherein the car body has a beam-shaped protrusion in the region of a sliding door, the protrusion extending in the longitudinal direction of the car body and containing a guide for guiding a movement of the sliding door.

The cross-section in FIG. 7 shows that a beam-shaped protrusion 80 can be used not only for arranging sensors, but can also include a guide 117 for a vehicle door 102. In the shown exemplary embodiment, the corresponding car body 109 of the rail vehicle 101 comprises a sliding door 102 only on one side at the illustrated cross-sectional position. As an alternative, the car body can also comprise a sliding door on the opposite side at the same cross-sectional position. Such sliding doors 102 can be moved only in a rectilinear direction for opening and closing. They differ from conventional doors, which are moved out of the closed position outwardly into an open position by way of a superimposed rotary movement, for example.

In summary, the following can be noted regarding the use of a beam-shaped protrusion on the outer surface of a rail vehicle: A beam-shaped protrusion can be present, for example, when sliding doors are used, which are not moved outwardly for opening. In this case, the beam-shaped protrusion can comprise at least part of the movement guide for moving the sliding door during opening and closing. As an alternative or in addition, the beam-shaped protrusion can comprise connecting lines, and in particular energy supply lines and signal links, via which the sensors at least partially disposed in the beam-shaped protrusion are connected to other devices of the rail vehicle, such as transmitters and processor units.

Figure 8:
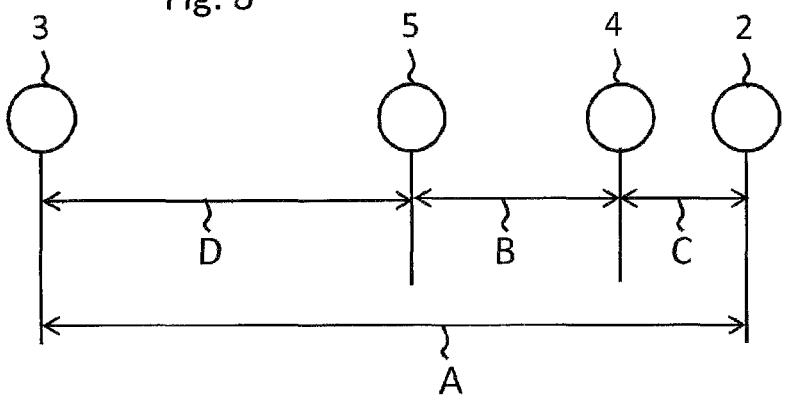
FIG. 8 schematically shows an arrangement of four image generation devices similarly to FIG. 2 or FIG. 6, wherein all four image generation devices are functional.

The arrangement comprising four image generation devices 2, 3, 4, 5 shown in FIG. 8 represents a specific exemplary embodiment for the configuration of the distances between the image generation devices disposed next to one another. However, other configurations are also possible. For example, those image generation devices disposed next to one another which directly adjoin one another can all have the same distances from one another, which is to say the distance from the respective nearest image generation device is the same for all image generation devices. The two center image generation devices thus each have a nearest image generation device in the opposite directions. In this case, it is always possible to form a first stereo pair having a smaller distance, and a second stereo pair having a larger distance, when any one of the four image generation devices fails.

In the case shown in FIG. 8, the largest distance between two image generation devices, which is to say the distance between the image generation device 2 and the image generation device 3, is denoted by A. The distances between directly adjoining image generation devices are denoted by B, C, D. The distances are all different in size. If all four image generation devices are able to supply images of the vehicle surroundings to an evaluation devices without fault, the image generation devices 2, 5 (having a distance that corresponds to the sum of the distances B and C), for example, are operated as the first stereo pair, and the image generation devices 2, 3 (having the distance A) are operated as the second stereo pair. The image generation device 2 is available as a back-up. Alternatively, for example, the image generation devices 3, 5 (having the distance D) could be operated as the first stereo pair, and the image generation devices 2, 4 (having the distance C) could be operated as the second stereo pair.

Figure 9:
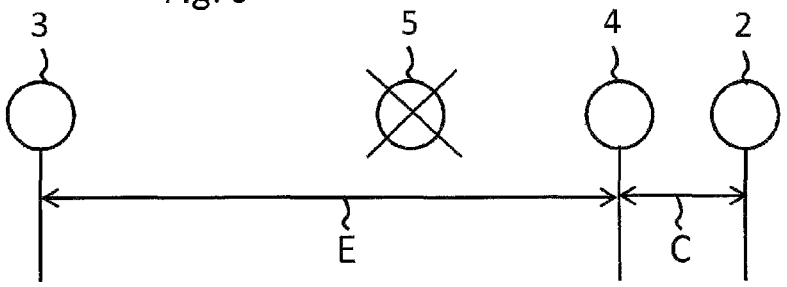
FIG. 9 shows the arrangement from FIG. 8, wherein, however, one of the four image generation devices has failed or is faulty, and still two stereo pairs of the image generation devices are formed.

If, as is shown symbolically by a cross in FIG. 9, the image generation device 5 has failed or is faulty, a new operating phase starts, in which the image generation devices 3, 4 (having the distance E) are operated as the first stereo pair, and the image generation devices 2, 4 (having the distance C) are operated as the second stereo pair. The distances C, E also differ considerably from one another, so that the different stereo pairs are well-suited for capturing differing depth ranges (which is to say distance ranges relative to the vehicle).

Figure 10:
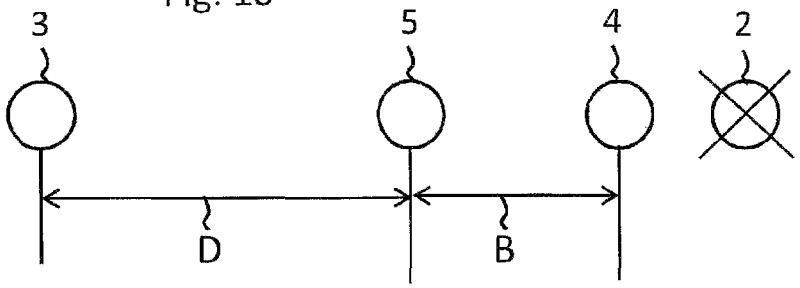
FIG. 10 shows the arrangement from FIG. 8, wherein, however, a different one of the four image generation devices than in FIG. 9 has failed or is faulty, and two different stereo pairs of the image generation devices than in FIG. 9 are formed.

If, as is shown symbolically by a cross in FIG. 10, the image generation device 2 has failed or is faulty, a new operating phase begins after the operating phases mentioned with respect to FIG. 8, in which the image generation devices 3, 5 (having the distance D) are operated as the first stereo pair, and the image generation devices 4, 5 (having the distance B) are operated as the second stereo pair. The distances B, D also differ considerably from one another, so that the different stereo pairs are well-suited for capturing differing depth ranges.

In the event of a failure or fault of one of the image generation devices 3, 4, what was described with respect to FIGS. 9 and 10 applies accordingly. It is always possible to form stereo pairs having differing distances.

The invention claimed is:

1. A rail vehicle comprising an image generation system for capturing a space outside the rail vehicle, wherein:

the image generation system comprises four image generation devices;

each of the four image generation devices during operation of the image generation system generates, or is able to generate, two-dimensional images of the space;

a first and a second of the four image generation devices are disposed at a first distance from one another on the rail vehicle and form a first stereo pair, which captures a first shared portion of the space from different viewing angles;

a third and a fourth of the four image generation devices are disposed at a second distance from one another on the rail vehicle and form a second stereo pair, which detects a second shared portion of the space from different viewing angles;

the first distance is greater than the second distance;

the first shared portion of the space and the second shared portion of the space have a shared spatial region; and the image generation system comprises an evaluation device, which is connected to the four image generation devices and, during operation of the image generation system, receives image data from the four image generation devices, the image generation system being designed to recognize that an evaluation of image data of a failed or faulty image generation device of the four image generation devices during an operating phase of the image generation system is not possible or flawed, it being possible for the failed or faulty image generation device to be any one of the four image generation devices, the evaluation device being designed, during the operating phase, to use the image data, which the evaluation device receives from three other of the four image generation devices that are not the failed or faulty image data image generation device, as image data that contain a first stereo image pair and a second stereo image pair, the first stereo image pair corresponding to the image data of two of the three other image generation devices which are disposed at a third distance from one another on the rail vehicle, and the second stereo image pair corresponding to the image data of two of the three other image generation devices which are disposed at a fourth distance from one another on the rail vehicle, and the third distance and the fourth distance being different in size.

2. The rail vehicle according to claim 1, wherein the four image generation devices are disposed in a front region of the rail vehicle in such a way that the shared spatial region is located ahead of the rail vehicle in a driving direction while the rail vehicle is traveling.

3. The rail vehicle according to claim 1, wherein the image generation system comprises a first processor unit and a second processor unit, which are each connected via image signal links to each of the four image generation devices, the first processor unit and the second processor unit being designed to calculate, independently of one another, depth information about a depth of image objects, which was captured by way of the two-dimensional images by one pair of the four image generation devices or by two different pairs of the four image generation devices, during operation of the image generation system from image signals received via the image signal links, and the depth extending in a direction transversely to an image plane of the two-dimensional images.

4. The rail vehicle according to claim 1, wherein the rail vehicle comprises a first processor unit and a second processor unit, which are each connected via image signal links to each of the four image generation devices, the first processor unit being connected to a first transmitter for transmitting image signals to a receiver remote from the rail vehicle, and the second processor unit being connected to a second transmitter for transmitting image signals to the receiver remote from the rail vehicle.

5. The rail vehicle according to claim 1, wherein it applies for each of the four image generation devices that the distances from any other of the four image generation devices are different in size.

6. The rail vehicle according to claim 1, wherein at least three of the four image generation devices disposed next to one another, so that all distances between the at least three of the four image generation devices are defined situated behind one another in a shared plane.

7. A system for operating a rail vehicle, comprising the rail vehicle according to claim 1, and comprising a control center, which is remote from the rail vehicle, wherein the rail vehicle comprises a first transmitter, via which, during operation of the rail vehicle, image signals from each of the four image generation devices or further processed image signals generated by a processor unit of the rail vehicle from the image signals are transmitted to a first receiver remote from the rail vehicle, the control center being connected to the first receiver and, during operation of the rail vehicle, receiving image signals received by the first receiver, the control center comprising an image display device, which during operation of the rail vehicle generates images from the received image signals and displays these, the control center comprising a control device, which during operation of the rail vehicle generates control signals for controlling a driving operation of the rail vehicle, the control center being connected to a second transmitter, via which, during operation, the control signals are transmitted to a second receiver of the rail vehicle, and the rail vehicle comprising a driving system, which during operation of the rail vehicle receives and processes the control signals generated by the control device of the control center and carries out the driving operation of the rail vehicle in keeping with the control signals.

8. A method for operating a rail vehicle, wherein the rail vehicle comprises an image generation device comprising at least four image generation devices for detecting a space outside the rail vehicle;

each of the at least four image generation devices generates, or is able to generate, two-dimensional images of the space;

a first and a second of the at least four image generation devices are disposed at a first distance from one another on the rail vehicle and form a first stereo pair, which captures a first shared portion of the space from different viewing angles;

a third and a fourth of the at least four image generation devices are disposed at a second distance from one another on the rail vehicle and form a second stereo pair, which detects a second shared portion of the space from different viewing angles;

the first distance is greater than the second distance;

the first shared portion the space and the second shared portion of the space have a shared spatial region; and an evaluation device of the image generation system, which is connected to the four image generation devices, during operation of the image generation system receives image data from the four image generation devices;

the method comprising: recognizing when an evaluation of image data of a failed or faulty image generation device of the four image generation devices during an operating phase of the image generation system is not possible or flawed;

it being possible for the failed and/or faulty image generation device to be any one of the four image generation devices, and using the image data, during the operating phase, which the evaluation device receives from three other of the four image generation devices which are not the failed or faulty image data image generation device, as image data that contain a first stereo image pair and a second stereo image pair, the first stereo image pair corresponding to the image data of two of the three other image generation devices which are disposed at a third distance from one another on the rail vehicle, and the second stereo image pair corresponding to the image data of two of the three other image generation devices which are disposed at a fourth distance from one another on the rail vehicle, and the third distance and the fourth distance being different in size.

9. The method according to claim 8, wherein the four image generation devices are disposed in a front region of the rail vehicle and capture the shared spatial region ahead of the rail vehicle in the driving direction while the rail vehicle is traveling.

10. The method according to claim 8, wherein the first to fourth image generation devices transmit image signals via image signal links both to a first processor unit of the rail vehicle and to a second processor unit of the rail vehicle, and the first processor unit and the second processor unit, independently of one another, calculate depth information about a depth of image objects, which was captured by way of the two-dimensional images by the first stereo pair or the second stereo pair from the image signals, the depth extending in a direction transversely to an image plane of the two-dimensional images.

11. The method according to claim 8, wherein a first processor unit and a second processor unit of the rail vehicle each receive image signals from each of the four image generation devices via image signal links the first processor unit transmitting image signals via a first transmitter to a receiver remote from the rail vehicle, and the second processor unit transmitting image signals via a second transmitter to the receiver remote from the rail vehicle.

12. The method according to claim 8, wherein image signals from each of the four image generation devices or further processed image signals generated by a processor unit of the rail vehicle from the image signals are transmitted via a transmitter to a first receiver remote from the rail vehicle and received by the first receiver as received image signals, images being generated from the received image signals in a control center remote from the rail vehicle and being displayed, control signals for controlling a driving operation of the rail vehicle being generated in the control center and transmitted to a second receiver of the rail vehicle, and the driving operation of the rail vehicle being carried out in keeping with the control signals.

13. The method according to claim 8, wherein it applies for each of the four image generation devices that the distances from any other of the four image generation devices are different in size.

14. The method according to claim 8, wherein at least three of the four image generation devices are disposed next to one another, so that all distances between the at least three of the four image generation devices are defined situated behind one another in a shared plane.

15. The method for operating a rail vehicle according to claim 8, as part of a system that also comprises a control center, which is remote from the rail vehicle, wherein during operation of the rail vehicle image signals from each of the four image generation devices or further processed image signals generated by a processor unit of the rail vehicle from the image signals are transmitted from a first transmitter of the rail vehicle to a first receiver remote from the rail vehicle, the control center receiving image signals received by the first receiver, the control center generating images from the received image signals by way of an image display device and displaying these, the control center generating control signals for controlling a driving operation of the rail vehicle by way of a control device, the control center transmitting the control signals via a second transmitter to a second receiver of the rail vehicle, and a driving system of the rail vehicle receiving and processing the control signals from the second receiver and carrying out the driving operation of the rail vehicle in keeping with the control signals.

* * * * *